US011089861B2

(12) United States Patent
Hohlbein et al.

(10) Patent No.: US 11,089,861 B2
(45) Date of Patent: Aug. 17, 2021

(54) ORAL CARE IMPLEMENT

(71) Applicant: COLGATE-PALMOLIVE COMPANY, New York, NY (US)

(72) Inventors: Douglas Joseph Hohlbein, Hopewell, NJ (US); Robert Moskovich, East Brunswick, NJ (US)

(73) Assignee: Colgate-Palmolive Company, New York, NY (US)

( * ) Notice: Subject to any disclaimer, the term of this patent is extended or adjusted under 35 U.S.C. 154(b) by 946 days.

(21) Appl. No.: 14/847,837

(22) Filed: Sep. 8, 2015

(65) Prior Publication Data

US 2017/0065070 A1 Mar. 9, 2017

(51) Int. Cl.

| | |
|---|---|
| ***A46B 9/04*** | (2006.01) |
| ***A46B 15/00*** | (2006.01) |
| ***A46D 1/00*** | (2006.01) |

(52) U.S. Cl.

CPC ..... *A46B 9/04* (2013.01); *A46B 15/0085* (2013.01); *A46B 15/0087* (2013.01); *A46D 1/0253* (2013.01); *A46D 1/0276* (2013.01); *A46B 2200/1066* (2013.01)

(58) Field of Classification Search

CPC ... A46B 9/04; A46B 15/0085; A46B 15/0089; A46B 15/0087; A46B 2200/1006; A46D 1/02; A46D 1/0207; A46D 1/023; A46D 1/0253; A46D 1/026; A46D 1/0276

USPC ..... 15/207.2

See application file for complete search history.

(56) References Cited

U.S. PATENT DOCUMENTS

| | | | | |
|---|---|---|---|---|
| 876,317 | A | 1/1908 | Booth | |
| 2,489,707 | A | 11/1949 | Eubanks | |
| 4,589,159 | A | 5/1986 | Streibel | |
| 6,141,819 | A * | 11/2000 | Driesen | A46D 1/00 15/167.1 |
| 6,163,918 | A * | 12/2000 | Weihrauch | A46D 1/00 15/167.1 |
| 6,678,914 | B2 * | 1/2004 | Needham | A46D 1/00 15/159.1 |
| 8,978,278 | B1 | 3/2015 | Rossi | |
| 9,554,640 | B2 | 1/2017 | Hohlbein | |
| 9,731,882 | B2 | 8/2017 | Lee | |
| 10,278,484 | B2 | 5/2019 | Hohlbein | |
| 2003/0217434 | A1 | 11/2003 | De Rosa | |
| 2004/0139569 | A1 | 7/2004 | Chen | |

(Continued)

FOREIGN PATENT DOCUMENTS

| | | |
|---|---|---|
| CN | 103561710 | 2/2014 |
| CN | 104284610 | 1/2015 |

(Continued)

OTHER PUBLICATIONS

International Search Report and Written Opinion for priority application No. PCT/US2016/049639, dated Nov. 15, 2016.

*Primary Examiner* — Laura C Guidotti

(57) ABSTRACT

An oral care implement having a body that includes a head portion and a handle portion. At least one bristle is mounted to the head portion. The at least one bristle may include an oral care feature. The body may include a core component and a sheath component. The core component may include a structural feature that corresponds to or is representative of the oral care feature of the at least one bristle. The core component may be visible through the sheath component.

12 Claims, 11 Drawing Sheets

(56) References Cited

U.S. PATENT DOCUMENTS

| | | | | |
|---|---|---|---|---|
| 2004/0205916 | A1* | 10/2004 | Byun | A45D 33/18 15/143.1 |
| 2005/0050662 | A1* | 3/2005 | Williams | A45D 33/36 15/143.1 |
| 2007/0209263 | A1* | 9/2007 | Hohlbein | A46B 5/02 40/625 |
| 2008/0155868 | A1 | 7/2008 | DeGennaro | |
| 2010/0101034 | A1 | 4/2010 | Huang | |
| 2011/0239387 | A1* | 10/2011 | Hohlbein | A46B 11/0003 15/104.93 |
| 2013/0048020 | A1* | 2/2013 | Hohlbein | A46B 5/00 134/6 |
| 2014/0173853 | A1* | 6/2014 | Kirchhofer | B29C 45/1642 16/430 |
| 2014/0325778 | A1 | 11/2014 | Chang | |
| 2015/0164215 | A1 | 6/2015 | Hohlbein | |
| 2015/0296967 | A1 | 10/2015 | Hohlbein | |
| 2016/0220014 | A1 | 8/2016 | Sprosta et al. | |

FOREIGN PATENT DOCUMENTS

| | | | | |
|---|---|---|---|---|
| CN | 104352054 | | 2/2015 | |
| FR | 2 911 260 | | 7/2008 | |
| GB | 351159 | | 6/1931 | |
| WO | WO 2000/05993 | | 2/2000 | |
| WO | 2007/106757 | | 9/2007 | |
| WO | WO 2013/172834 | A1 * | 11/2013 | A46B 5/02 |
| WO | WO 2015/085528 | | 6/2015 | |
| WO | WO 2015/085536 | | 6/2015 | |

* cited by examiner

ORAL CARE IMPLEMENT

BACKGROUND

The oral care implement industry is rather competitive and innovation of an oral care implement with desirable aesthetics can be financially beneficial to a seller of such products. Specifically, although oral care implements are increasingly being designed with cleaning elements or bristles having unique benefits, it is often the overall visual appearance of an oral care implement that drives sales rather than its unique benefits. Part of the reason for this is that it is difficult to inform the consumer that the oral care implement provides a specific benefit. Thus, a need exists for an oral care implement that readily informs the consumer of the unique benefits of using that oral care implement.

BRIEF SUMMARY

The present invention may be directed, in one aspect, to an oral care implement having a body that includes a head portion and a handle portion. At least one bristle tuft is mounted to the head portion, the bristle tuft including a plurality of bristles. At least some of the bristles may include an oral care feature. The body also includes a core component and a sheath component. The core component may include a structural feature that corresponds to or is representative of the oral care feature of the bristles.

In one embodiment, the invention can be an oral care implement comprising: a body comprising a handle portion and a head portion; at least one bristle mounted to and extending from the head portion, the at least one bristle having an oral care feature; the body comprising a core component and a sheath component surrounding the core component; the core component comprising a structural feature that corresponds to the oral care feature and that is visible through the sheath component.

In another embodiment, the invention can be an oral care implement comprising: a body comprising a handle portion and a head portion; at least one bristle mounted to and extending from the head portion, the at least one bristle having an oral care feature; and the body comprising a visible structural feature that corresponds to the oral care feature.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
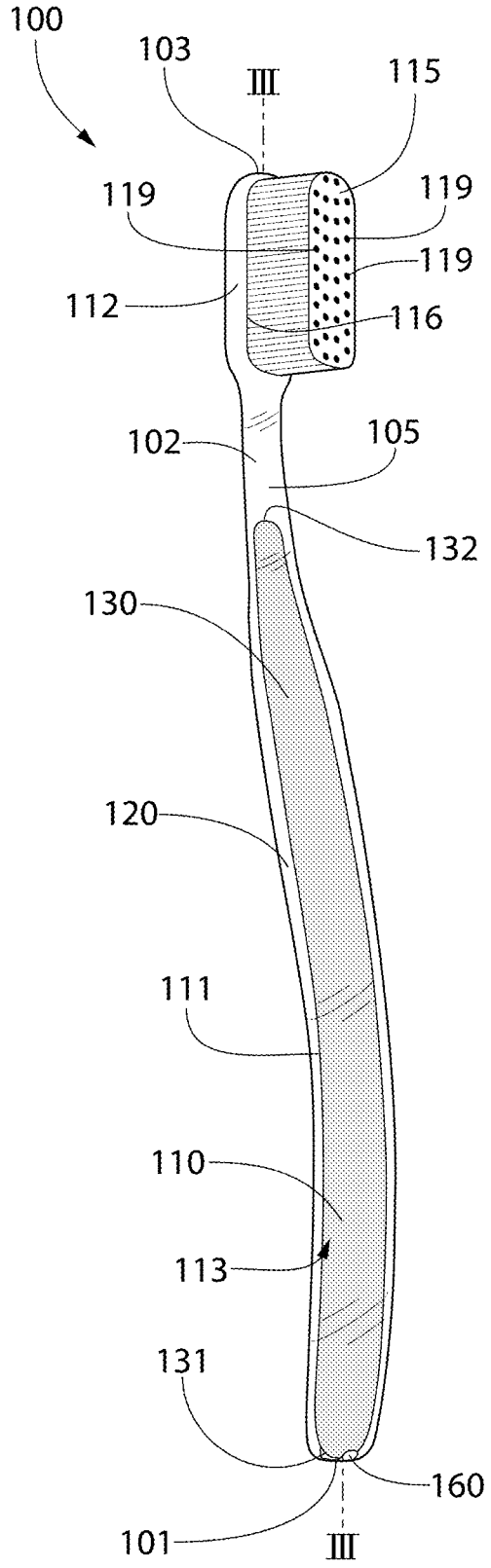
FIG. 1 is a front perspective view of an oral care implement in accordance with a first embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 2:
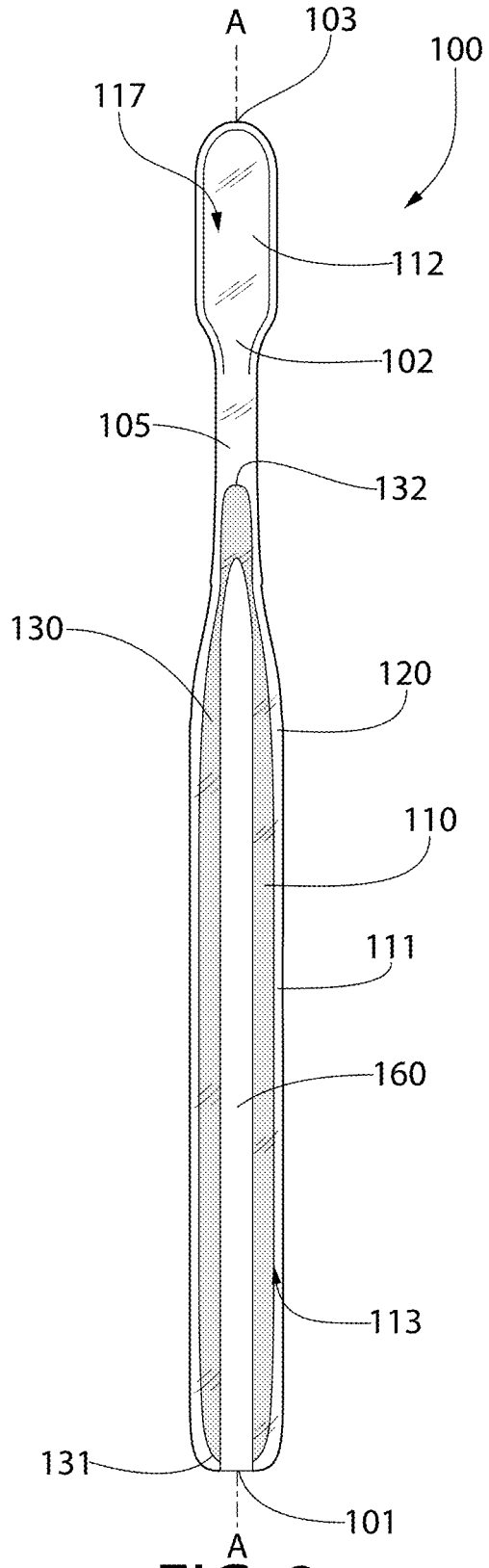
FIG. 2 is a rear view of the oral care implement of FIG. 1.
Figure 3:
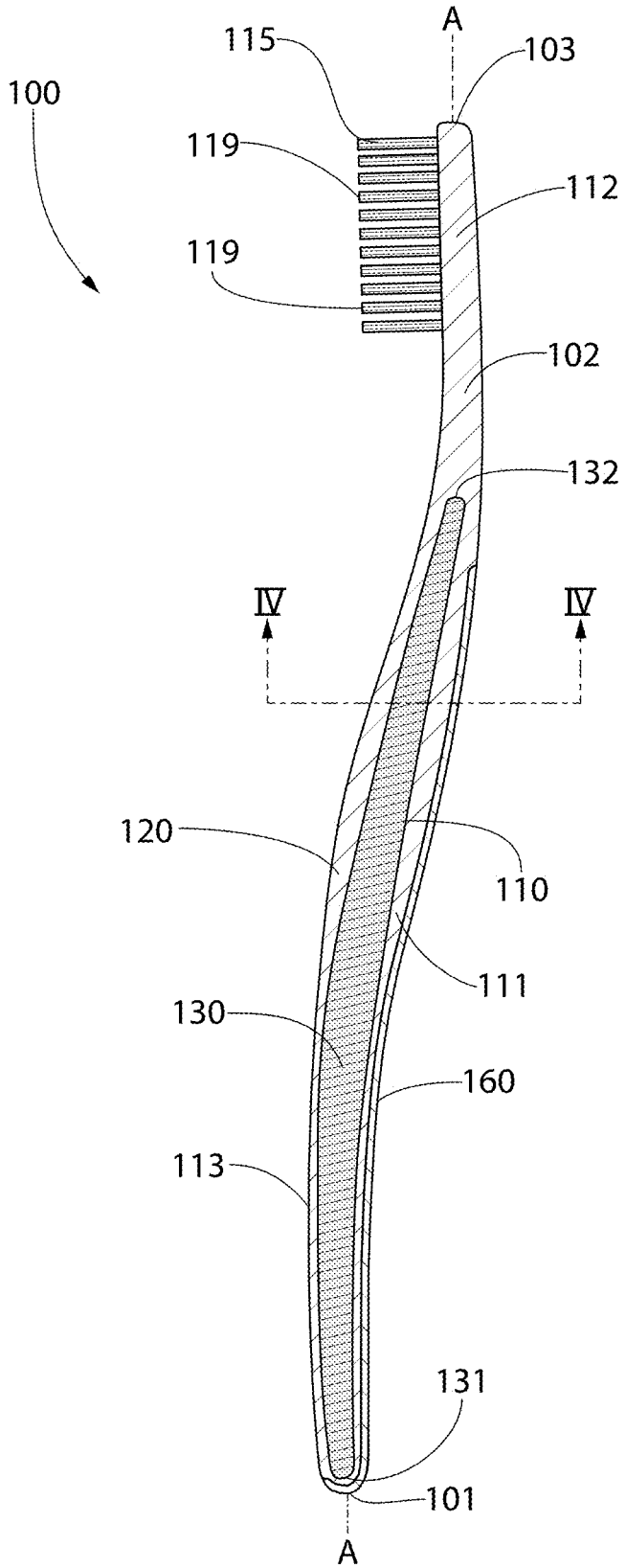
FIG. 3 is a cross-sectional view taken along line III-III of FIG. 1.
Figure 4:
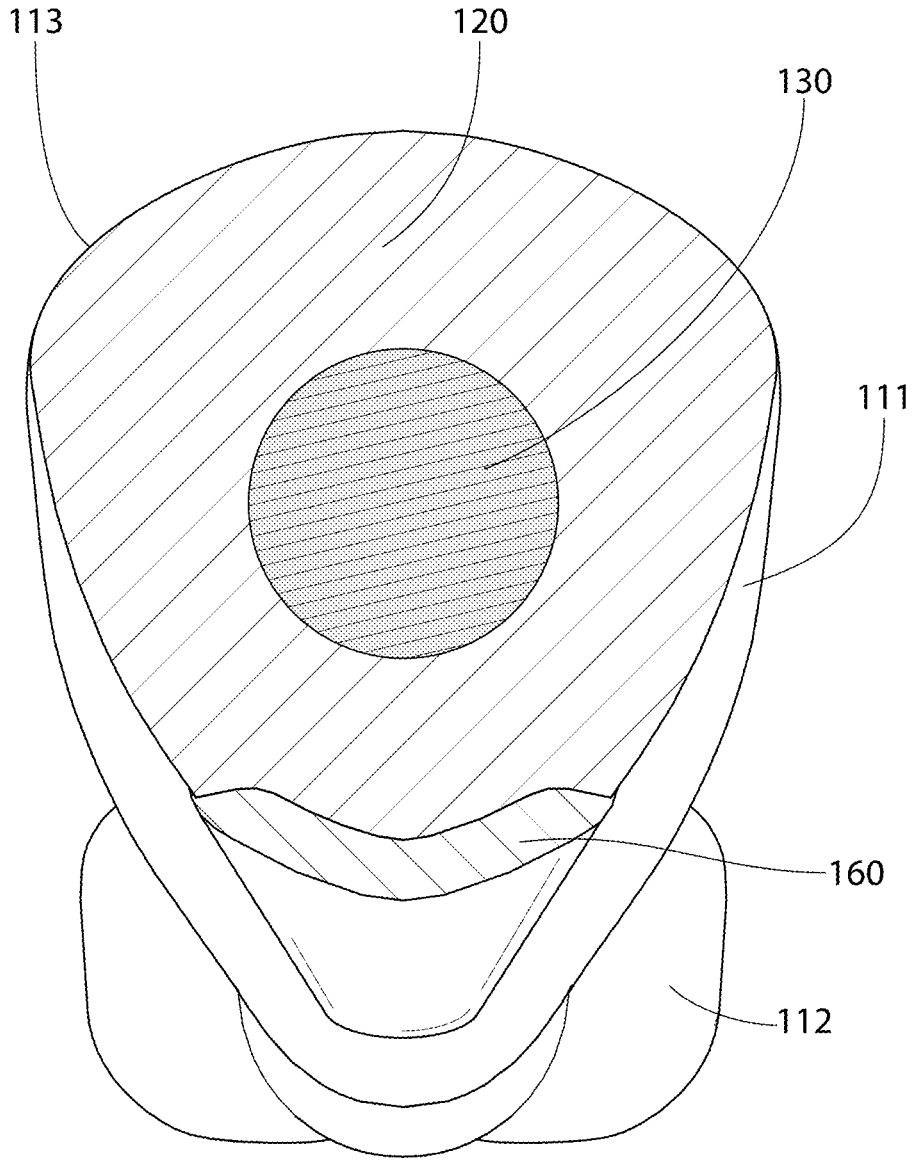
FIG. 4 is a cross-sectional view taken along line IV-IV of FIG. 3.

Referring first to FIGS. 1 and 2 concurrently, an oral care implement 100 is illustrated in accordance with one embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Furthermore, in still other embodiments the implement may not be limited to one that is used for oral care, and may be any type of personal care implement such as a manual or electric razor, a hairbrush, or the like. Thus, it is to be understood that the inventive concepts discussed herein can be applied to any type of oral or personal care implement unless a specific type of oral or personal care implement is specified in the claims.

In the exemplified embodiment, the oral care implement 100 comprises a body 110 and an elastomeric overmold 160. The body comprises a handle portion 111 and a head portion 112. The body 110 is formed of one or more rigid plastic materials such as for example without limitation polymers and copolymers of ethylene, propylene, butadiene, vinyl compounds, polyesters such as polyethylene terephthalate (PET), styrene-acrylonitrile (SAN), polyurethane, polyamide, cellulosic, acrylic, acrylonitrile butadiene styrene (ABS), or the like. The body 110 has an outer surface 113 and the elastomeric overmold 160 is coupled to the outer surface 113 such as by injection molding, adhesion, fasteners, or the like.

In certain embodiments the elastomeric overmold 160 may form a grip to prevent slippage and enhance comfort during use of the oral care implement 100, although the elastomeric overmold 160 may also be omitted in certain embodiments as desired. The elastomeric overmold 160 may be formed of a thermoplastic elastomer or other rubber-like material that enhances comfort and gripability of the oral care implement 100 during use. Although in the exemplified embodiment the elastomeric overmold 160 is only illustrated as a strip on the rear surface of the handle portion 111 of the body 110, the invention is not to be so limited. In other embodiments the elastomeric overmold 160 may extend onto the front surface of the handle 111 of the body 110 to form a forefinger and thumb grip to increase comfort and prevent slippage during use. Furthermore, the elastomeric overmold 160 may extend onto the rear surface of the head portion 112 of the body 110 to operate as a tongue and soft tissue cleanser. The elastomeric overmold 160 may also extend onto the front surface of the head portion 112 of the body 110 to operate as a rubber tooth polishing member. The elastomeric overmold 160 may be a single unitary piece formed via a single shot in an injection mold or may include several discontinuous or separated segments formed of the elastomeric material via multiple shots in an injection mold. Furthermore, various textures, protrusions, channels, ridges, or the like may be formed as part of the elastomeric overmold 160.

The handle portion 111 of the body 110 extends from a proximal end 101 of the oral care implement 100 to a distal end 102 of the handle portion 111. Thus, in the exemplified embodiment the handle portion 111 includes the portion of the oral care implement 100 that is gripped during use and a neck 105 of the oral care implement 100 that forms the transition region between the handle portion 111 and the head portion 112. The handle portion 111 of the body 110 is an elongated structure that provides the mechanism by which the user can hold and manipulate the oral care implement 100 during use. In the exemplified embodiment, the handle portion 111 is generically depicted having various contours for user comfort. Of course, the invention is not to be limited by the specific shape illustrated for the handle portion 111 in all embodiments and in certain other embodiments the handle portion 111 can take on a wide variety of shapes, contours, and configurations, none of which are limiting of the present invention unless so specified in the claims.

The head portion 112 of the body 110 extends from the distal end 102 of the handle portion 111 to a distal end 103 of the head portion 112. In the exemplified embodiment, a plurality of tooth cleaning elements 115 are coupled to and extend from the head portion 112 of the body 110. The term "tooth cleaning elements" is used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. The tooth cleaning elements may include tapered bristles, non-tapered (i.e., end rounded) bristles, and combinations thereof. Any combination of the various types of tooth cleaning elements may be used on the oral care implement 100 in different embodiments.

In the exemplified embodiment, the plurality of tooth cleaning elements 115 comprises a plurality of bristle tufts mounted to and extending from the head portion 112 of the body 110. In other embodiments the plurality of tooth cleaning elements 115 may comprise at least one bristle tuft mounted to and extending from the head portion 112. In the exemplified embodiment, each of the bristle tufts comprises a plurality of bristles 119. As will be discussed in more detail below, at least one bristle 119 of at least one of the bristle tufts, or each of the bristles 119 of at least one of the bristle tufts, or each of the bristles 119 of each of the bristle tufts, has an oral care feature. The oral care feature is a characteristic of the bristle 119 that imparts a particular benefit to a user during use of the oral care implement 100. The different types of oral care features that can imparted to a user by the bristles 119 will be described in more detail below with specific reference to FIGS. 5-11.

In embodiments that use elastomeric elements as one or more of the tooth cleaning elements 115, suitable elastomeric materials may include any biocompatible resilient material suitable for uses in an oral hygiene apparatus. To provide optimum comfort as well as cleaning benefits, the elastomeric material of any such tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used. The tooth cleaning elements 115 may be coupled to the head portion 112 of the body 110 using any technique known in the art, such as stapling, anchor free tufting, in-mold tufting, AMR, or the like. The invention is not to be limited by the manner in which the tooth cleaning elements 115 are coupled to the head portion 112 in all embodiments.

The head portion 112 of the oral care implement 100 is coupled to the handle portion 111 and comprises a front surface 116 and an opposing rear surface 117. The tooth cleaning elements 115 extend from the front surface 116 of the head portion 112. A tongue or soft tissue cleaner (not depicted) may be positioned on the rear surface 117 of the head portion 112. In the exemplified embodiment, the head portion 112 is formed integrally with the handle portion 111 as a single unitary structure using a molding, milling, machining, or other suitable process. However, in other embodiments the handle portion 111 and the head portion 112 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus the handle portion 111 and the head portion 112 may, in certain embodiments, be formed of any of the rigid plastic materials described above, although the invention is not to be so limited in all embodiments and other materials that are commonly used during toothbrush manufacture may also be used.

Referring to FIGS. 1-4A concurrently, the oral care implement 100 will be further described. The body 110 of the oral care implement 100 extends from the proximal end 101 of the handle portion 111 to the distal end 103 of the head portion 112 along a longitudinal axis A-A. The body 110 of the oral care implement 100 comprises a sheath component 120 and a core component 130. In the exemplified embodiment, only the handle portion 111 of the body 110 comprises the sheath and core components 120, 130 and the head portion 112 of the body 110 comprises only the sheath component 120. Thus, in certain embodiments the sheath component 120 and the core component 130 collectively form the handle portion 111 of the body 110. However, in the exemplified embodiment the core component 130 does not extend to the head portion 112 of the body 110. Thus, in the exemplified embodiment the sheath component 120 forms an entirety of the head portion 112 of the body 110. Of course, the invention is not to be so limited in all embodiments and in other embodiments the core component 130 may extend into the head portion 112 of the body 110 of the oral care implement 100

Stated another way, the body 110 has a length measured from the distal end 101 of the handle portion 111 to the distal end 103 of the head portion 112. The sheath component 120 extends the entire length of the body 110. The core component 130 extends from a first end 131 adjacent the distal end 101 of the handle portion 111 to a second end 132 adjacent the proximal end 102 of the handle portion 111. The core component 130 has a length that is less than the length of the body 110 so that although the core component 130 extends from adjacent to the proximal end 101 of the body 110, the core component 130 does not extend into the head portion 112 of the body 110. Of course, the length of the core component 130 may be adjusted in certain embodiments so that the core component 130 may extend into the head portion 112 if so desired.

The core component 130 is elongated in a direction of the longitudinal axis A-A. In the embodiment exemplified in FIGS. 1-4A, the core component 130 is rounded at both the first and second ends 131, 132. However, in other embodiments, such as FIGS. 5 and 11 described below, the core component 130 may be tapered at one or both of the first and/or second ends 131, 132, split at one or both of the first and/or second ends 131, 132, or the like. The core component 130 may extend along an entirety of the handle portion 111 of the body 110 and approximately two-thirds to three-fourths of the length of the body 110. Thus, in certain embodiments a ratio of the length of the handle portion 111 to the length of the core component 130 may be between 1.3:1 to 1.5:1, or more specifically 1.35:1 to 1.45:1.

The core component 130 forms an interior longitudinal section of the body 110 and the sheath component 120 forms an exterior longitudinal section of the body 110. At any transverse plane taken through the body 110 that intersects both the sheath and core components 120, 130, the sheath component 120 has an outer diameter that is greater than an outer diameter of the core component 130. Furthermore, at such a transverse plane an inner diameter of the sheath component 120 is substantially identical to the outer diameter of the core component 130. Thus, the sheath component 120 substantially surrounds the core component 120. More specifically, the core component 130 is substantially entirely surrounded or enclosed by the sheath component 120. Stated another way, the core component 130 is circumferentially surrounded by the sheath component 120 along its entire length so that no portion of the core component 130 is exposed. In the exemplified embodiment, the sheath component 120 completely surrounds the core component 120 so that the entire outer surface 113 of the body 110 is formed by the sheath component 120 and no portion of the core component 130 extends to and is exposed on the outer surface 113 of the body 110. Of course, the invention is not to be so limited in all embodiments and in some embodiments the core component 130 may protrude through the sheath component 120 so as to extend to and form a portion of the outer surface 113 of the body 110

Thus, the core component 130 appears to float within the sheath component 120. In one embodiment, the sheath component 120 may be formed of a transparent material and the core component 130 may be formed of an opaque material (or a translucent material or a tinted material) so that the core component 130 is visible through the sheath component 120 to achieve a desirable aesthetic effect. In other embodiments the sheath and core components 120, 130 may both be substantially transparent. In still other embodiments the sheath component 120 may be translucent rather than transparent. It is desirable in some embodiments that the core component 130 be visible through the sheath component 120 regardless of whether the sheath component 120 is transparent, translucent, tinted, or the like.

The invention is not to be limited by the shape, length, thickness, and size of the core component 130 in all embodiments unless specifically claimed as such. The core and sheath components 120, 130 of the body 110 can be formed using sandwich molding technologies in a single mold cavity or by using multiple mold cavity injection molding processes.

In the exemplified embodiment, the sheath component 120 comprises a substantially translucent material. As used herein, the term translucent may include materials that are translucent that transmit and diffuse light so that objects cannot be seen clearly through the material and materials that are transparent and allow all light to pass through so that objects can be seen clearly through the material. The term translucent does not include materials that are opaque such that objects cannot be seen through the material at all. Thus, as used herein translucent should be interpreted to mean translucent and/or transparent. Materials that are translucent may be tinted such that they may include hints of color. Specifically, in some embodiments the sheath component 120 may be tinted and translucent. Objects placed behind a translucent material are visible through the translucent material. Tinted/translucent materials may be desirable for the sheath component 120 to add to the aesthetics of the oral care implement 100 while still permitting the core component 130 to be visible through the sheath component 120. When the term transparent is used herein it should be understood to mean transparent (i.e., clear) but not also translucent. In some embodiments transparent materials may be desired for the sheath component 120 to ensure that the core component 130 and any features thereof are readily visible through the sheath component 120.

Furthermore, in the exemplified embodiment the material that forms the sheath component 120 is a rigid material because it forms the main structure of the handle portion 111 and head portion 112 of the body 110 of the oral care implement 100. Thus, the material that forms the sheath component 120 is rigid to ensure that the oral care implement 100 can be handled without bending or flexing during use. The term rigid material does not mean that the material cannot bend at all because all materials will bend if a sufficient force is applied thereto. Rather, the term rigid material refers to a hard material that resists bending/flexing under normal toothbrushing pressures and forces. Thus, during normal toothbrushing the sheath component 120 will retain its shape without significant flexing or bending. In certain embodiments the first material of the sheath component 120 may be a hard plastic material such as copolyester, polyethylene terephthalate (PET), styrene-acrylonitrile (SAN), polyurethane, polyethylene, polyamide, cellulosic, acrylic, acrylonitrile butadiene styrene (ABS), or the like or any of the other materials described above as forming a part of the body 110 of the oral care implement 100. Thus, in embodiments of the invention the material of the sheath component 120 does not include elastomeric materials such as thermoplastic elastomers (TPE), rubbers, or the like.

Furthermore, as noted above, in the exemplified embodiment the sheath component 120 is substantially translucent or transparent. Thus, regardless of the degree of translucency/transparency of the sheath component 120, the sheath component 120 is not opaque so that the sheath component 120 can be at least partially seen through. As a result, the core component 130 is visible through the sheath component 120 despite the core component 130 being substantially or entirely surrounded or encapsulated/enveloped by the sheath component 120. In certain embodiments the sheath component 120 is completely clear and completely transparent. In other embodiments the sheath component 120 is tinted with a color but is still translucent.

As will be described below with reference to FIGS. 5-12, in certain embodiments the core component 130 may be used to communicate information about one or more of the bristles 119 to a consumer or user of the oral care implement 100. Thus, due to the visibility of the core component 130 through the sheath component 120, specific structural features of the core component 130 may be used to represent a specific oral care feature of one or more of the bristles 119 of the oral care implement 100. Specifically, one or more of the bristles 119 may have an oral care feature. In certain embodiments all of the bristles 119 on the head portion 112 may have an oral care feature, in other embodiments all of the bristles 119 of at least one bristle tuft may have an oral care feature, and in other embodiments at least one of the bristles 119 may have an oral care feature. An oral care feature is a feature or characteristic of the bristle 119 that imparts a particular benefit to a user during use of the oral care implement 100 to clean a user's teeth. Specifically, the oral care feature may be a unique tip shape of the bristles 119 that offers an interdental cleaning, a soft feel, or an anti-sensitivity benefit to a user during use, a texture on the surfaces of the bristles 119 that offers abrasive cleaning to a user's teeth, twisted or spiral profiles of the bristles 119 that offers added tooth whitening during use, speckles or additives within the bristles 119 that offers any of various oral care benefits described in more detail below, or the like. As noted above, the core component 130 may include a structural feature that indicates to a consumer that the bristle 119 has one of the particular oral care features.

Figure 5:
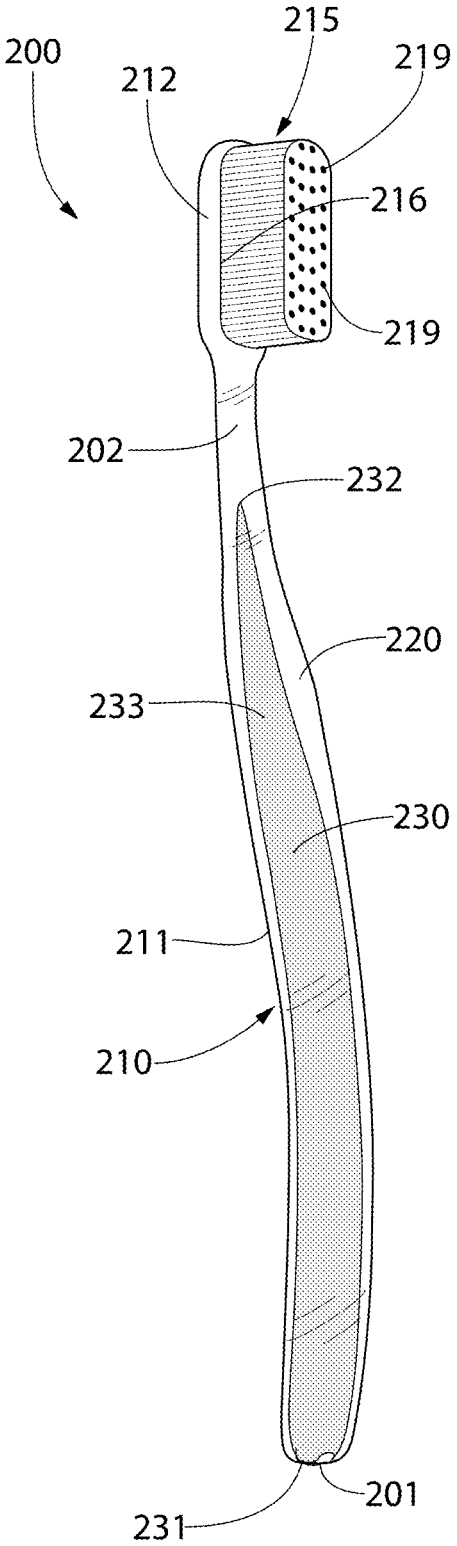
FIG. 5 is a front perspective view of an oral care implement in accordance with a second embodiment of the present invention.
Figure 5A:
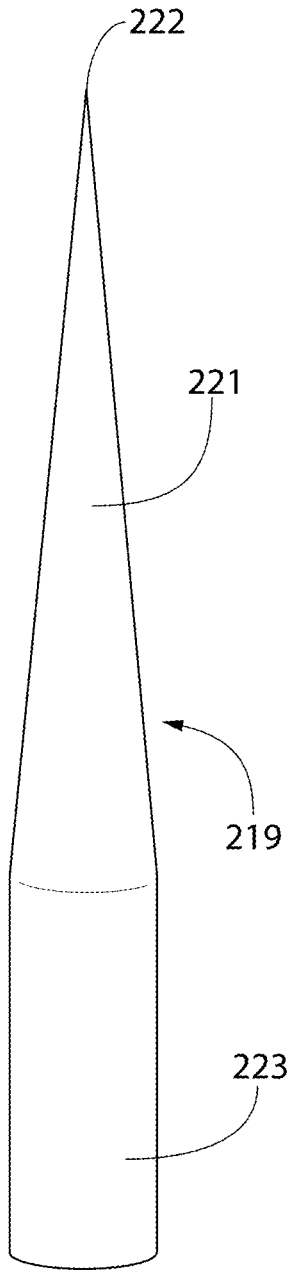
FIG. 5A is a schematic illustration of a bristle on the oral care implement of FIG. 5.

Referring to FIGS. 5 and 5A concurrently, one exemplary embodiment of an oral care implement 200 will be described. The oral care implement 200 is similar to the oral care implement 100 except for the differences described herein below. The features of the oral care implement 200 that are described above with regard to the oral care implement 100 will not be repeated herein in the interest of brevity, it being understood that the description above with regard to the oral care implement 100 applies. Furthermore, features of the oral care implement 200 will be similarly numbered as similar features on the oral care implement 100 except that the 200-series of numbers will be used. For features of the oral care implement 200 that are numbered but not described, it should be understood that the description of the similar feature with regard to the oral care implement 100 applies.

The oral care implement 200 comprises a body 210 having a handle portion 211 and a head portion 212. The body 210 comprises a sheath component 220 and a core component 230 that are similar in structure to the sheath and core components 120, 130 of the oral care implement 100 described above except for the differences described below. A plurality of tooth cleaning element 215 extends from a front surface 216 of the head portion 212. As described above with regard to the oral care implement 100, the plurality of bristles 215 may include at least one, or a plurality of bristle tufts. Furthermore, each of the bristle tufts may include a plurality of bristles 219.

FIG. 5A illustrates one of the bristles 219 of the tooth cleaning elements 215. As noted above, at least one, or each, of the bristles 219 has an oral care feature. In this embodiment the oral care feature of the bristles 219 is a tapered bristle tip portion 221. Specifically, in this embodiment some or all of the bristles 219 have a cross-sectional area that steadily decreases towards a terminal end 222 of the bristle 219. The bristles 219 may have a cylindrical base portion 223 that extends along a portion of a length of the bristle 219 and the tapered tip portion 221 extending from the cylindrical base portion 223 to the terminal end 222 of the bristle 219. Alternatively, the bristle 219 may taper along its entire length. The specific dimensions of the bristle 219 are not to be limiting in all embodiments, but rather the bristle 219 may be any bristle that tapers along at least a portion of its length.

Tapered bristles such as the bristle 219 may be used for interdental cleaning during toothbrushing or for anti-sensitivity brushing. Specifically, tapered bristles are known to be softer than standard cylindrical bristles. Thus, during brushing tapered bristles are gentler than standard cylindrical bristles and therefore desirable for persons with sensitive mouths where brushing with standard cylindrical bristles may be painful. Furthermore, a consumer may desire a tapered bristle for its benefits of being able to reach deep into the crevices between gums and teeth to remove disease-causing germs therefrom. It is desirable to be able to inform a consumer that the oral care implement 200 comprises the bristles 219 with the oral care feature of the tapered bristle tip portion 221 so that the consumer can readily perceive that the oral care implement 200 will provide the aforementioned benefits. This unique oral care feature of the bristles 219 is not readily apparent to a typical consumer simply by viewing the bristles 219. Therefore, the oral care implement 200 is designed with a conspicuous structural feature, described below, that may inform the user of the oral care feature of the bristles 219.

Referring to FIG. 5, in the exemplified embodiment the core component 230 comprises a structural feature that corresponds to the oral care feature of the bristles 219 and that is visible through the sheath component 220. As noted above, the sheath component 220 may be translucent or transparent, thereby making the core component 230 visible through the sheath component 220. The core component 230 may be opaque or colored to make the core component 230 more readily visible through the sheath component 220. The structural feature of the core component 230 corresponds to the oral care feature of the bristles 219 so that the structural feature of the core component 230 can serve as an indicator to a consumer that the bristles 219 have the oral care feature of a tapered bristle tip portion 221. Thus, the structural feature of the core component 230 may be considered to be representative or indicative of the oral care feature of the bristles 219. Upon a user viewing the structural feature of the core component 230, the user will be informed of the oral care feature of the bristles 219.

In this embodiment, the core component 230 extends from a first end 231 adjacent a proximal end 201 of the body 210 of the oral care implement 200 to a second end 232 adjacent a distal end 202 of the handle portion 211 of the body 210. Furthermore, in this embodiment the core component 230 has a tapered end portion 233 such that the core component 230 tapers as it extends towards the second end 232. Specifically, the cross-sectional area of the core component 230 decreases as it extends towards its second end 232. In the exemplified embodiment the first end 231 of the core component 230 is rounded. However, the invention is not to be so limited and in other embodiments the first and second ends 231, 232 of the core component 230 may both be tapered.

Thus, the structural feature of the core component 230 of the oral care implement 200 is the tapered end portion 233 and the oral care feature of the bristle 219 of the oral care implement 200 is the tapered bristle tip portion 221. The tapered end portion 233 of the core component 230 corresponds to, is representative of, or is indicative of the tapered bristle tip portion 221 of the bristle 219. A consumer who views the oral care implement 200 will see the tapered end portion 233 of the core component 230 because it is readily visible to a consumer and will understand that this means that at least one of, or a plurality of, the bristles 219 are tapered or have a tapered bristle tip portion 221. Thus, if a consumer is looking for an oral care implement with tapered bristles, the consumer will easily be made aware that the oral care implement 200 contains this oral care feature and will provide the relevant benefits based on the structural feature (i.e., the tapered end portion 233) of the core component 230.

Figure 6:
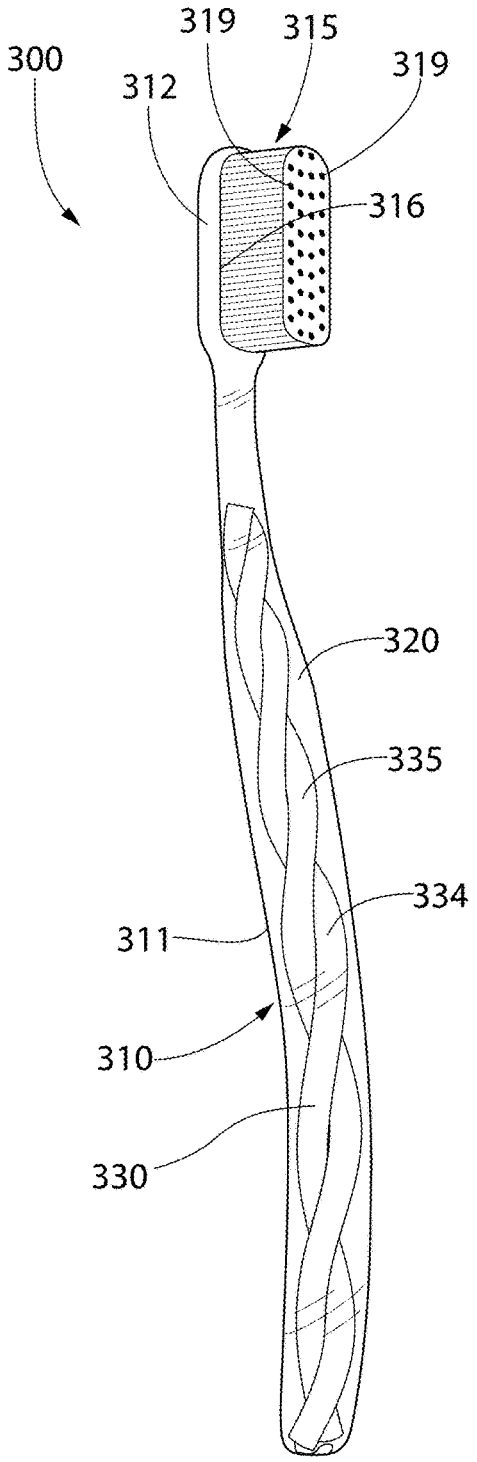
FIG. 6 is a front perspective view of an oral care implement in accordance with a third embodiment of the present invention.
Figure 6A:
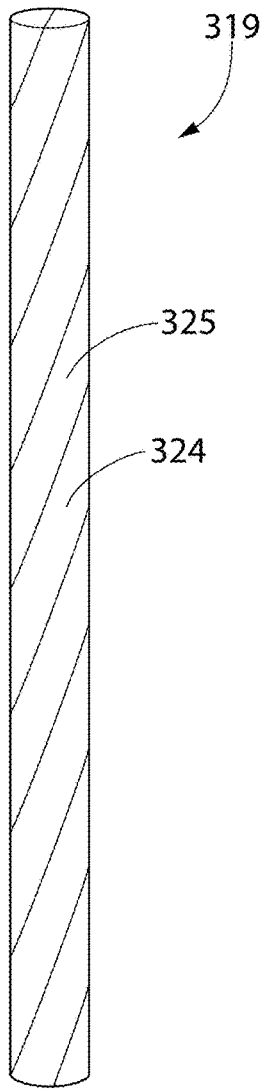
FIG. 6A is a schematic illustration of a bristle on the oral care implement of FIG. 6.

Referring now to FIGS. 6 and 6A concurrently, another exemplary embodiment of an oral care implement 300 will be described. The oral care implement 300 is similar to the oral care implement 100 except for the differences described herein below. The features of the oral care implement 300 that are described above with regard to the oral care implement 100 will not be repeated herein in the interest of brevity, it being understood that the description above with regard to the oral care implement 100 applies. Furthermore, features of the oral care implement 300 will be similarly numbered as similar features on the oral care implement 100 except that the 300-series of numbers will be used. For features of the oral care implement 300 that are numbered but not described, it should be understood that the description of the similar feature on the oral care implement 100 applies.

The oral care implement 300 comprises a body 310 having a handle portion 311 and a head portion 312. The body 310 comprises a sheath component 320 and a core component 330 that are similar in structure to the sheath and core components 120, 130 of the oral care implement 100 described above except for the differences described below. A plurality of tooth cleaning elements 315 extend from a front surface 316 of the head portion 312. As described above with regard to the oral care implement 100, the plurality of bristles 315 may include at least one, or a plurality of bristle tufts. Furthermore, each of the bristle tufts may include a plurality of bristles 319.

FIG. 6A illustrates one of the bristles 319 of the tooth cleaning elements 315. As noted above, at least one, or each, of the bristles 319 has an oral care feature. In this embodiment the oral care feature of the bristles 319 is intertwined bristle strand components 324, 325. Intertwined bristle strand component bristles, also known as spiral bristles or helical bristles, may be used for increasing the tooth whitening effect during tooth brushing. To form the bristles 319, the bristle strand components 324, 324 are wound around one another. It should be appreciated that the number of windings and the pitch of the windings is not to be limiting of the present invention in all embodiments. Rather, the bristle strand components 324, 325 can be intertwined in various ways to form the bristles 319. Each of the bristle strand components 324 325 (also referred to as the first bristle strand component 324 and the second bristle strand component 325) may be cylindrical or other polygonal shapes. Furthermore, in certain embodiments one of the bristle strand components 324, 325 may have grooves, ridges, pockets or recessed areas within which the other bristle strand component 324, 325 is disposed when the bristle strand components 324, 325 are intertwined together.

In certain embodiments, the bristle strand components 324, 325 can be coextruded to form the bristle 319. In such an embodiment, the bristle 319 may be considered to be a monofilament. In other embodiments, the bristle strand components 324, 325 can be extruded separately from one another and then later twisted together to form the bristle 319. The exact manner of forming the bristle 319 is not to be limiting of the present invention unless so specified in the claims. An outer surface of the bristle 319 can be smooth as illustrated in FIG. 6A or it may have ridges and valleys as the bristle strand components 324, 325 wind around one another.

The oral care feature of intertwined bristle strand components 324, 325 may be used to enhance tooth whitening during tooth brushing. Specifically, the bristle 319 formed by intertwined bristle strand components 324, 324 has a more rigid structure and more stability than a conventional bristle and thus may be better able to remove bacteria that causes tooth discoloration. Thus, if an oral care implement such as the oral care implement 300 includes bristles 319 with the oral care feature of the intertwined bristle strand components 324, 325, it may be desirable to symbolically indicate this fact to a consumer. The unique oral care feature of the bristles 319 may not be readily apparent to a typical consumer simply by viewing the bristles 319. Therefore, the oral care implement 300 may be designed with a conspicuous structural feature, described below, that may inform the user of the oral care feature of the bristles 319.

Referring to FIG. 6, in the exemplified embodiment the core component 30 comprises a structural feature that corresponds to the oral care feature of the bristles 319 and is visible through the sheath component 320 (due to the transparency/translucency of the sheath component 320). The structural feature of the core component 330 corresponds to the oral care feature of the bristles 319 so that the structural feature of the core component 330 can serve as an indicator to a consumer that the bristles 319 have the oral care feature of intertwined bristle strand components 324, 325. Thus, the structural feature of the core component 330 may be considered to be representative or indicative of the oral care feature of the bristles 319. Upon a user viewing the structural feature of the core component 330, the user will be informed of the oral care feature of the bristles 219.

In this embodiment, the core component 330 comprises intertwined core strand components 334, 335. Specifically, the core strand components 334, 335 are intertwined around one another to form a helical or spiral appearance. Thus, in this embodiment the structural feature of the core component 330 of the oral care implement 300 is the intertwined core strand components 334, 335 and the oral care feature of the bristle 319 of the oral care implement is the intertwined bristle strand components 324, 325. The intertwined core strand components 334, 335 correspond to, are representative of, or are indicative of the intertwined bristle strand components 324, 325. A consumer who views the oral care implement 300 will see the intertwined core strand components 324, 325 of the core component 330 because they are readily visible to a consumer and will understand that this means that at least one of, or a plurality of, the bristles 319 are spiral bristles and have intertwined bristle strand components 324, 325. Thus, if a consumer is looking for an oral care implement with spiral/helical bristles, the consumer will easily be made aware that the oral care implement 300 contains this oral care feature and will provide the relevant benefits based on the structural feature (i.e., the intertwined core strand components 334, 335) of the core component 230.

Figure 7:
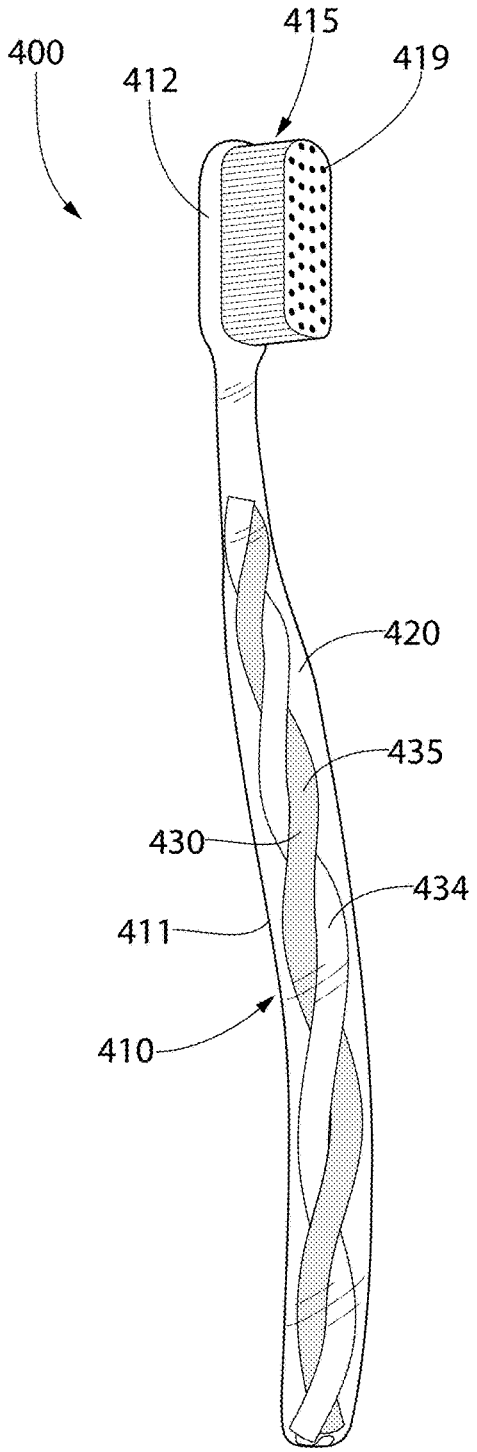
FIG. 7 is a front perspective view of an oral care implement in accordance with a fourth embodiment of the present invention.
Figure 7A:
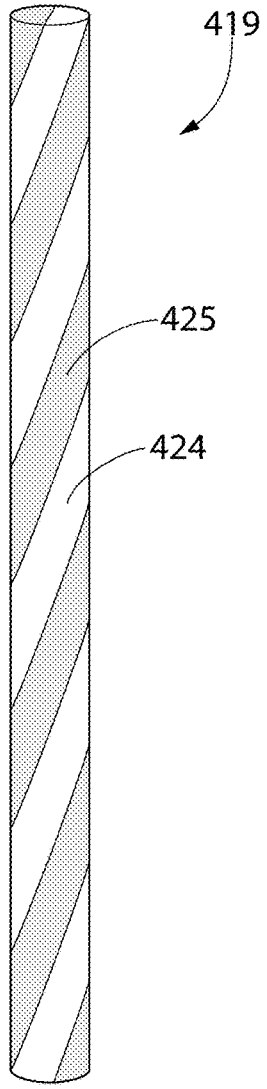
FIG. 7A is a schematic illustration of a bristle on the oral care implement of FIG. 7.

Referring briefly to FIGS. 7 and 7A concurrently, an oral care implement 400 will be described that is very similar to the oral care implement 300. The features of the oral care implement 400 that are described above with regard to the oral care implements 100, 300 will not be repeated herein in the interest of brevity, it being understood that the description above with regard to the oral care implements 100, 300 applies. Furthermore, features of the oral care implement 400 will be similarly numbered as similar features on the oral care implements 100, 300 except that the 400-series of numbers will be used. For features of the oral care implement 400 that are numbered but not described, it should be understood that the description of the similar feature on the oral care implement 100 applies.

The oral care implement 400 is identical to the oral care implement 300 in that it includes bristles 400 having the oral care feature of intertwined core strand components 424, 425 and a core component 430 having the representative structural feature of intertwined core strand components 434, 435. Thus, the appearance of the core component 430 is indicative and representative of the spiral feature of the bristle 419. However, in this embodiment the intertwined bristle strand components comprise a first bristle strand component 434 that is a first color and a second bristle strand component 425 that is a second color, the first color being different than the second color. Similarly, the intertwined core strand components comprise a first core strand component 434 that is the first color and a second core strand component 435 that is the second color. This feature adds to the aesthetic of the oral care implement 400 and provides an additional corresponding feature in the color of the strand components of the core component 430 and the bristle 419.

Figure 8:
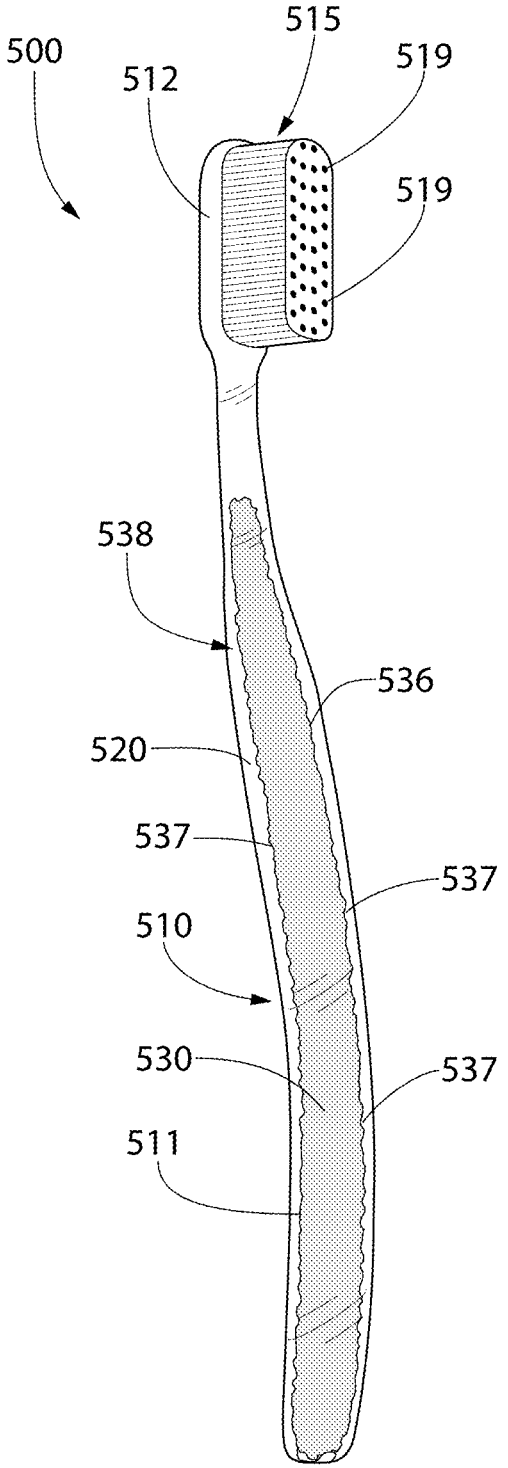
FIG. 8 is a front perspective view of an oral care implement in accordance with a fifth embodiment of the present invention.
Figure 8A:
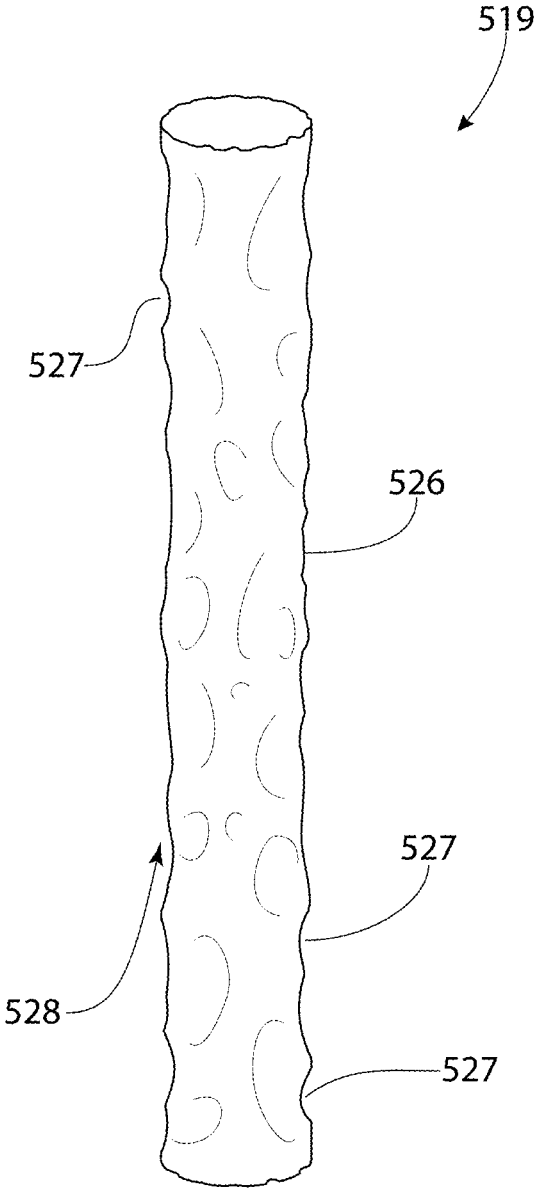
FIG. 8A is a schematic illustration of a bristle on the oral care implement of FIG. 8.

Referring now to FIGS. 8 and 8A concurrently, another exemplary embodiment of an oral care implement 5300 will be described. The oral care implement 500 is similar to the oral care implement 100 except for the differences described herein below. The features of the oral care implement 500 that are described above with regard to the oral care implement 100 will not be repeated herein in the interest of brevity, it being understood that the description above with regard to the oral care implement 100 applies. Furthermore, features of the oral care implement 500 will be similarly numbered as similar features on the oral care implement 100 except that the 500-series of numbers will be used. For features of the oral care implement 500 that are numbered but not described, it should be understood that the description of the similar feature on the oral care implement 100 applies.

The oral care implement 500 comprises a body 510 having a handle portion 511 and a head portion 512. The body 510 comprises a sheath component 520 and a core component 530 that are similar in structure to the sheath and core components 120, 130 of the oral care implement 100 described above except for the differences described below. A plurality of tooth cleaning element 515 extends from a front surface 516 of the head portion 512. As described above with regard to the oral care implement 100, the plurality of bristles 515 may include at least one, or a plurality of bristle tufts. Furthermore, each of the bristle tufts may include a plurality of bristles 519.

FIG. 8A illustrates one of the bristles 519 of the tooth cleaning elements 515. As noted above, at least one, or each, of the bristles 519 has an oral care feature. The bristles 519 have an outer surface 526 and the oral care feature is an uneven bristle outer surface topography 528. In the exemplified embodiment, the uneven bristle outer surface topography 528 comprises a plurality of depressions 527 formed into the outer surface 526 of the bristle 519. Of course, the invention is not to be so limited in all embodiments and the uneven bristle outer surface topography 528 may instead comprise a plurality of ridges, bumps, protrusions, or the like. Forming the bristle 519 with the uneven bristle outer surface topography 528 increases the roughness and coefficient of friction of the surface creating better abrasive action when contacting surfaces of the teeth to achieve the foregoing improved polishing and stain removal characteristics.

The uneven bristle outer surface topography 528 of the bristle 519 may have a surface profile contoured by any number and type of raised and/or recessed surface features, such as the depressions 527. This includes for example without limitation a plurality of regular or irregular shaped recesses, protuberances, valleys, ridges/peaks, surface porosity comprised of open pores, polygonal and non-polygonal geometric-shaped protuberances or recesses, and other structures configured to provide an undulating and irregular surface profile that increases frictional resistance when placed in sliding contact with the surfaces of the teeth. The uneven bristle outer surface topography 528 may be arranged in uniform or irregular/random patterns and have any suitable dimensions. The invention is expressly not limited to any particular shape, pattern, dimensions, or type of uneven bristle outer surface topography 528 unless specifically limited by the language of the claims.

The uneven bristle outer surface topography 528 on the outer surface 526 of the bristle 519 may be created by any suitable formative process now known or to be developed and is expressly not limiting of the invention. In certain exemplary embodiments, the uneven bristle outer surface topography 528 may be formed by erosive chemical action on the exposed bristle surface which configure the outer surface 526 of the bristle 519 (e.g. acidic solutions, etc.) and are operable to roughen or mottle the exposed surface. In other exemplary embodiments, the uneven bristle outer surface topography 528 may be formed by abrasive mechanical action on the exposed bristle surface such as via the use of sandpaper, grinding wheels, or similar abrasive tools operable to roughen or mottle the surface. In yet other exemplary embodiments, the uneven bristle outer surface topography 528 may be formed by non-abrasive mechanical action such as via embossing, stamping, etc. on the exposed bristle surface. In additional exemplary embodiments, the uneven bristle outer surface topography 528 may be formed by molding. In other exemplary embodiments, the uneven bristle outer surface topography 528 may be formed by the material structure itself of the bristle 519 such as by using a porous material that can be created by injecting a gas into the bristle mold when the polymeric material is in a heated and flowable state during the injection molding or casting process. This will create a porous structure throughout the material in which open pores disposed at and penetrating the outer surface 526 of the bristle 519 will form a randomly pore riddled surface structure. The size of the pores can be varied to produce either a coarser or finer surface finish for controlling the degree of abrasive action on the teeth (i.e. smaller pores produce finer finish with less aggressive abrasion and larger pores produce coarser finish with more aggressive abrasion). This concomitantly provides either more or less polishing action on the teeth depending on whether a coarser or finer surface finish is created, respectively.

Variations and combinations of the foregoing methods and approaches to creating the uneven bristle outer surface topography 528 on the outer surface 526 of the bristle 519 may be used. The method(s) selected will be based in part by the desired type and pattern of uneven bristle outer surface topography 528 to be created.

It is desirable to be able to inform a consumer that the oral care implement 500 comprises the bristles 519 with the oral care feature of the uneven bristle outer surface topography 528 so that the consumer can readily perceive that the oral care implement 500 will provide the aforementioned benefits. This unique oral care feature of the bristles 519 is not readily apparent to a typical consumer simply by viewing the bristles 519. Therefore, the oral care implement 500 is designed with a conspicuous structural feature, described below, that may inform the user of the oral care feature of the bristles 519.

Referring to FIG. 8, in the exemplified embodiment the core component 530 comprises a structural feature that corresponds to the oral care feature of the bristles 519 and is visible through the sheath component 520 (due to the transparency/translucency of the sheath component 520). The structural feature of the core component 530 corresponds to the oral care feature of the bristles 519 so that the structural feature of the core component 530 can serve as an indicator to a consumer that the bristles 519 have the oral care feature of the uneven bristle outer surface topography 528. Thus, the structural feature of the core component 530 may be considered to be representative or indicative of the oral care feature of the bristles 519. Upon a user viewing the structural feature of the core component 530, the user will be informed of the oral care feature of the bristles 519.

In this embodiment, the core component 530 comprises an uneven core outer surface topography 538. Specifically, the core component 530 comprises an outer surface 536 and the core component 530 is formed to have the uneven core outer surface topography 538. In the exemplified embodiment, the uneven core outer surface topography 538 comprises a plurality of depressions 537 formed into the outer surface 536 of the core component 530. Of course, the invention is not to be so limited in all embodiments and in other embodiments the uneven core outer surface topography 538 may comprise a plurality of regular or irregular shaped recesses, protuberances, valleys, ridges/peaks, surface porosity comprised of open pores, polygonal and non-polygonal geometric-shaped protuberances or recesses, and other structures configured to provide an undulating and irregular surface profile. The uneven outer core surface topography 538 can be formed during the injection molding process by forming the core component 530 within a mold cavity having this surface feature or it can be formed after the injection molding process by manually or machine scraping of the core component 530. In certain embodiments, the depressions 537 of the core component 530 have the same shape as the depressions 527 of the bristle 519. Furthermore, in embodiments that do not use depressions 527 the features resulting in the uneven core outer surface topography 538 may have the same shape as the features resulting in the uneven bristle outer surface topography 528.

Thus, in the oral care implement 500, at least one of the bristles 519 comprises an oral care feature that is the uneven bristle outer surface topography 528 and the core component 530 comprises a structural feature that is the uneven core outer surface topography 538. The uneven core outer surface topography 538 corresponds to or is indicative of the uneven bristle outer surface topography 528 of the bristle 519. Thus, a consumer who views the oral care implement 500 will see the uneven core outer surface topography 538 and will understand that this means that at least one of, or a plurality of, the bristles 519 have an uneven bristle outer surface topography 528. Thus, if a consumer is looking for an oral care implement with bristles having an uneven outer surface topography, the consumer will easily be made aware that the oral care implement 500 contains this oral care feature and will provide the relevant benefits based on the structural feature (i.e., the uneven core outer surface topography 538) of the core component 530.

Figure 9:
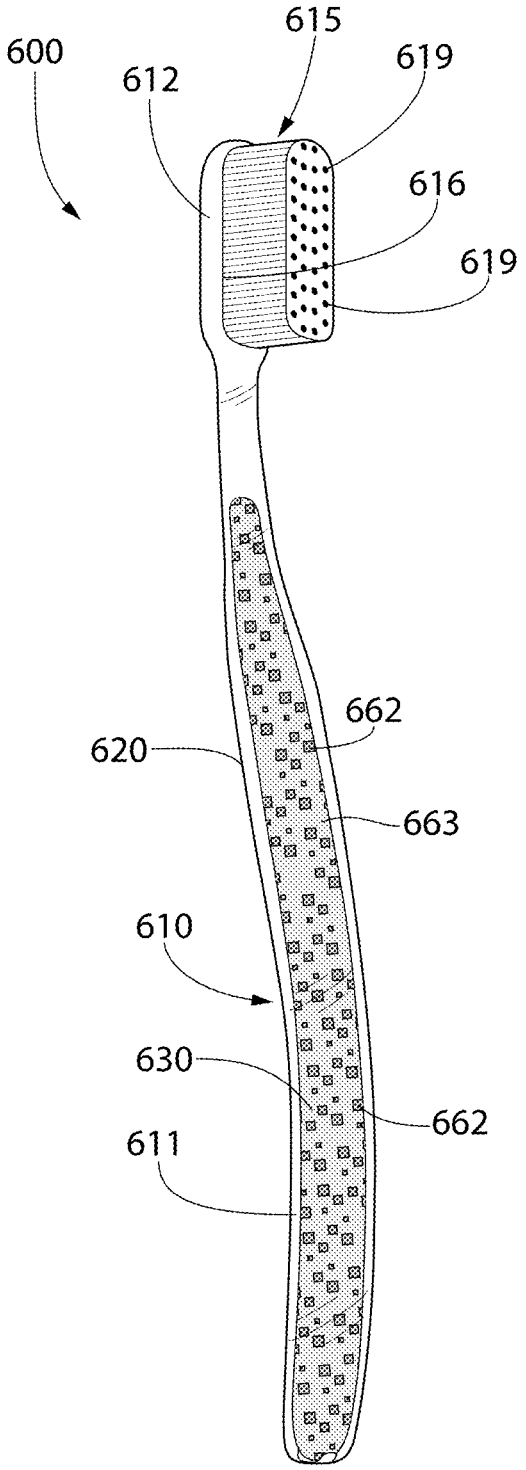
FIG. 9 is a front perspective view of an oral care implement in accordance with a sixth embodiment of the present invention.
Figure 9A:
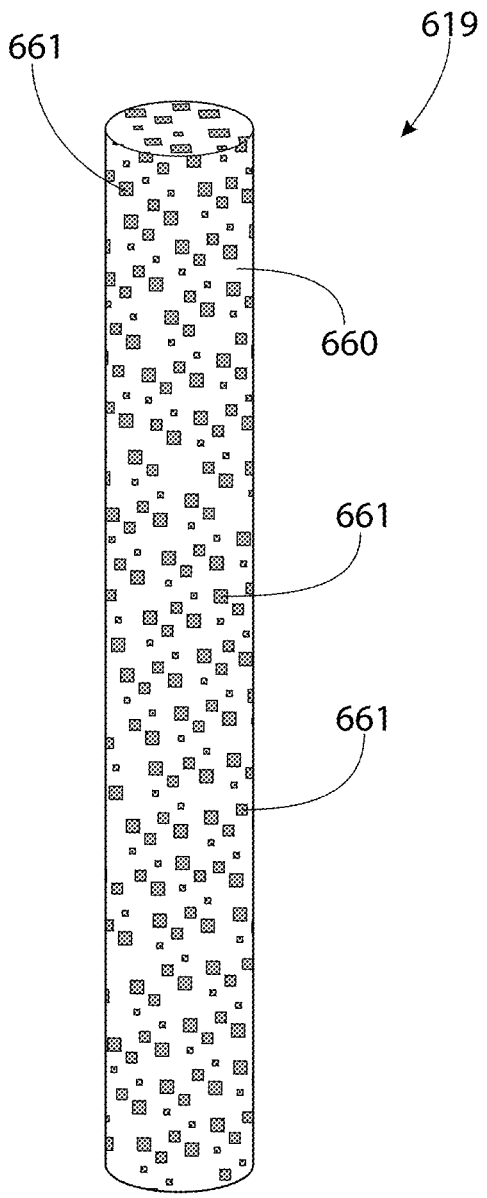
FIG. 9A is a schematic illustration of a bristle on the oral care implement of FIG. 9.

Referring briefly to FIGS. 9 and 9A concurrently, an oral care implement 600 will be described that is very similar to the oral care implement 100. The features of the oral care implement 600 that are described above with regard to the oral care implement 100 will not be repeated herein in the interest of brevity, it being understood that the description above with regard to the oral care implement 100 applies.

Furthermore, features of the oral care implement 600 will be similarly numbered as similar features on the oral care implement 100 except that the 600-series of numbers will be used. For features of the oral care implement 600 that are numbered but not described, it should be understood that the description of the similar feature on the oral care implement 100 applies.

The oral care implement 600 comprises a body 610 having a handle portion 611 and a head portion 612. The body 610 comprises a sheath component 620 and a core component 630 that are similar in structure to the sheath and core components 120, 130 of the oral care implement 100 described above except for the differences described below. A plurality of tooth cleaning element 615 extends from a front surface 616 of the head portion 612. As described above with regard to the oral care implement 100, the plurality of bristles 615 may include at least one, or a plurality of bristle tufts. Furthermore, each of the bristle tufts may include a plurality of bristles 619.

Referring to FIG. 9A, the details of at least one of the bristles 619 will be described. The bristle 619 comprises a strand 660 formed of a typical material used for forming toothbrush bristles such as nylon and an additive 661. Thus, in this embodiment the additive 661 is the oral care feature of the bristle 619. In the exemplified embodiment the additive 661 is illustrated as particles dispersed throughout the strand 660 of the bristle 619 but the invention is not to be so limited in all embodiments and the additive 661 may be a coating on the bristle 619 or the additive 661 may be impregnated into the material of the strand 660. In the exemplified embodiment, the additive 661 of the oral care feature of the bristle 619 is dispersed within the strand 660 of the bristle 619 in particulate form. It is desirable that the additive 661 can be dispensed into a user's oral cavity during use of the oral care implement 600 in order to impart benefits of the additive 661 to the user.

The invention is not to be limited by the particular additive 661 used unless specifically recited as such in the claims. Thus, in some embodiments the additive 661 may be any of a variety of oral care additives that provide proven benefits to a user's oral health. Such oral care additives include, without limitation, tooth whitening agents; tooth anti-sensitivity agents; lotus seed; lotus flower, bamboo salt; jasmine; corn mint; camellia; aloe; gingko; tea tree oil; xylitol; sea salt; vitamin C; ginger; cactus; baking soda; pine tree salt; green tea; white pearl; black pearl; charcoal powder; nephrite or jade and Ag/Au+. The lotus seed is the extract from lotus seeds and is a natural herb for anti-heating and the prevention of gum bleeding. The lotus flower is the extract from the lotus flower and is a natural herb for anti-heating and the prevention of gum bleeding. Bamboo salt is the combination of a bamboo extract and salt and is used to diminish inflammation and has anti-bacterial effects. Jasmine is an extract from the jasmine flower and is a natural herb for anti-heating, preventing gum bleeding and for mouth freshening. Corn mint is an extract from a corn mint leaf and is a natural herb for anti-heating, anti-bacterial uses and mouth freshening. Camellia is an extract from the camellia flower and is a natural herb for anti-heating and the prevention of gum bleeding. Aloe is an extract from the aloe leaf and is a natural herb for inflammation reduction and has anti-bacterial effects. Gingko is an extract from the gingko leaf and is a natural herb for inflammation reduction and has anti-bacterial effects. Tea tree oil is an extract from a tea tree and is a natural herb for diminishing inflammation and has anti-bacterial effects. Xylitol is an extract from plants such as corn, sugar cane, oak, birch, etc. and can be used for preventing tooth decay. Sea salt is an extract from the sea and can be used to reduce inflammation and has anti-bacterial effects. Vitamin C is an extract from food and can be used to prevent gum bleeding and as an antioxidant. Ginger is an extract from ginger and is a natural plant for diminishing inflammation and has anti-bacterial effects. Cactus is an extract from a cactus and it a natural plant for reducing inflammation and can be used as an antioxidant. Backing soda is a chemistry product and can be used as an enamel protectant. Pine tree salt is a mixture of the extract from pine trees and salt and is an ancient Chinese medicine for preventing inflammation and anti-heating. Green tea is an extract from the green tea leaf and is a natural herb to prevent halitosis and inhibit bacteria growth. White pearl is a kind of pearl powder and can be used for teeth whitening and teeth health improvement by calcium absorption. Black pearl is a kind of pearl powder that can be used for teeth whitening, cleaning and stain removal. Charcoal is made from an oak tree by carbonization and it helps to for moisture adjustment and to reduce the growth of bacteria. Nephrite (jade) is a kind of nephrite powder and can be used to prevent gum disease and boost the blood circulation of the gums. Ag/Au is an anti-bacterial additive contained in the Ag/Au ion (i.e., silver/gold) and can be used to inhibit bacterial growth. In certain embodiments, each of the first and second oral care additives are selected from a group consisting of a mixture of pine tree extract and salt, a tea leaf extract, a pearl powder, a nephrite powder, a charcoal powder, and an antibacterial material.

It is desirable to be able to inform a consumer that the oral care implement 600 comprises the bristles 619 with the oral care feature of the additive 661 so that the consumer can readily perceive that the oral care implement 600 will provide the aforementioned benefits. This unique oral care feature of the bristles 619 is not readily apparent to a typical consumer simply by viewing the bristles 619. Therefore, the oral care implement 600 is designed with a conspicuous structural feature, described below, that may inform the user of the oral care feature of the bristles 619.

Referring to FIG. 9, in order to communicate to a consumer that the bristle 619 includes the additive 661, the core component 630 of the oral care implement 600 includes the structural feature of particulates 662 dispersed in a carrier material 663. Thus, the core component 630 comprises the carrier material 663 and the structural feature of the core component 630 is the plurality of particulates 662 dispersed within the carrier material 663. Thus, a consumer who views the oral care implement 600 will readily be able to view the particulates 662 through the sheath component 620 and within the core component 630. This will communicate to the user that at least one of the bristles 619 of the oral care implement 600 includes the additive 661.

In the exemplified embodiment the particulates 662 of the structural feature of the core component 630 and the additive 661 of the oral care feature of the bristles 619 are the same color. However, in alternative embodiments the colors of the additive 661 and the particulates 662 may be different. Furthermore, in certain embodiments the particulates 662 of the structural feature of the core component 630 have a color that is indicative of a trigeminal response triggered by the additive 661 of the oral care feature of the bristle 619. A trigeminal response is the result of stimulation of the trigeminal nerve of a human and it produces a physiological effect without a taste, with such effect usually represented by the terms cooling, tingle, and hot (or heat). Thus, for example, if the additive 661 creates a cooling sensation in a user's oral cavity during use, the particulate 662 may be blue to be indicative of this cooling sensation. If the additive 661 creates a heating sensation in a user's oral cavity during use, the particulate 662 may be red to be indicative of this heating sensation.

Examples of additives that can create a trigeminal response include capsaicin, found naturally in chili peppers, which can be used to provide a tingle, a hot or warm massage, or a heating or warm, soothing sensation to a user. Capsaicin is also known to provide pain relief and numbing sensations when topically applied. Some examples of additives that produce cooling sensations include menthol and camphor. Most of the polyols, including maltitol syrup, sorbitol, mannitol, erythritol, isomalt and xylitol, also provide a cooling sensation. The coolest of the polyols, erythritol, provides a distinct cooling sensation. Both erythritol and xylitol cool the mouth and fight the sensation of dry mouth commonly associated with prescription drugs and dental hygiene products.

In some embodiments, the particulates 662 in the core component 630 may be black in color to communicate that the additive 661 of the bristle 619 is a charcoal or black pearl ingredient. In other embodiments the particulate 662 in the core component 630 is silver colored to communicate that the additive 661 of the bristle 619 is a silver based antibacterial ingredient. In still other embodiments, the particulate 662 in the core component 630 is white colored to communicate that the additive 661 of the bristle 619 is a salt or white pearl ingredient. In another embodiment, the particulate 662 in the core component 630 may be a silver sparkle colored to communicate that the additive 661 of the bristle 619 is a sparkle filament. In further embodiments, the particulate 662 in the core component 630 is linear particles to communicate that the additive 661 of the bristle 619 is silk or carbon fiber filament ingredients. The above are exemplary only and are not intended to be limiting of the present invention and other additives and other colors/shapes for the particulates 662 are possible within the scope of the present application.

Figure 10:
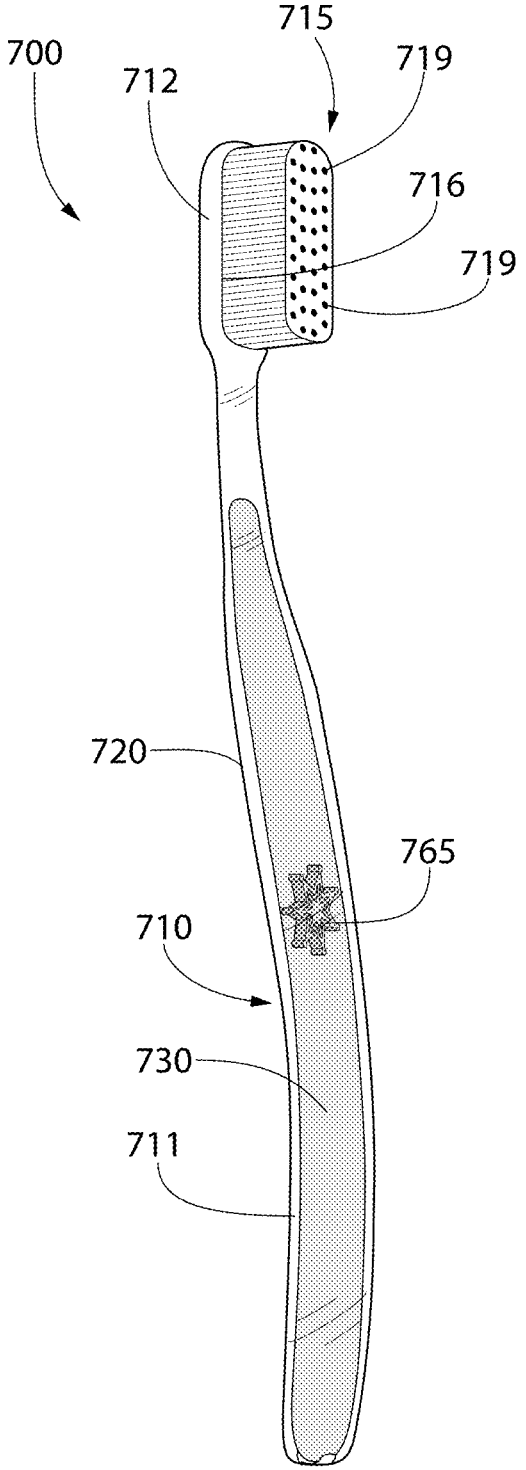
FIG. 10 is a front perspective view of an oral care implement in accordance with a seventh embodiment of the present invention.
Figure 10A:
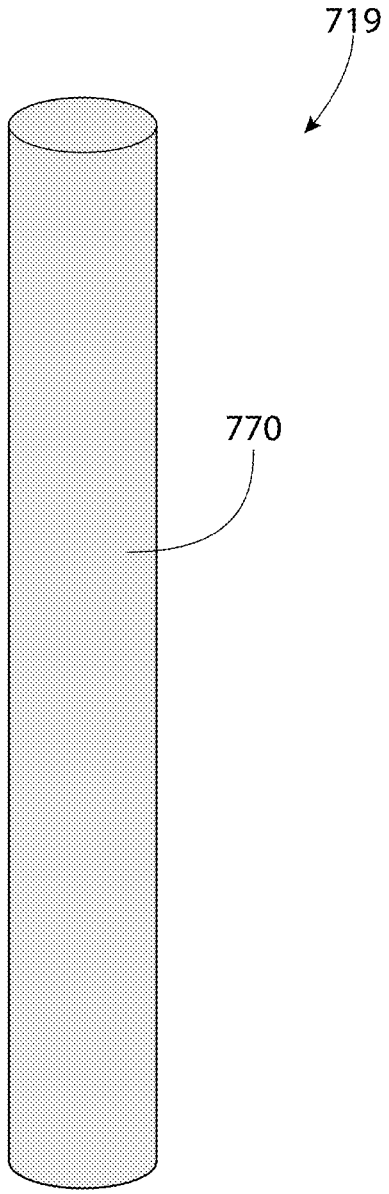
FIG. 10A is a schematic illustration of a bristle on the oral care implement of FIG. 10.

Referring to FIGS. 10 and 10A concurrently, one exemplary embodiment of an oral care implement 700 will be described. The oral care implement 700 is similar to the oral care implement 100 except for the differences described herein below. The features of the oral care implement 700 that are described above with regard to the oral care implement 100 will not be repeated herein in the interest of brevity, it being understood that the description above with regard to the oral care implement 100 applies. Furthermore, features of the oral care implement 700 will be similarly numbered as similar features on the oral care implement 100 except that the 700-series of numbers will be used. For features of the oral care implement 700 that are numbered but not described, it should be understood that the description of the similar feature in the oral care implement 100 applies.

The oral care implement 700 comprises a body 710 having a handle portion 711 and a head portion 712. The body 710 comprises a sheath component 720 and a core component 730 that are similar in structure to the sheath and core components 120, 130 of the oral care implement 100 described above except for the differences described below. A plurality of tooth cleaning element 715 extends from a front surface 716 of the head portion 712. As described above with regard to the oral care implement 100, the plurality of bristles 715 may include at least one, or a plurality of bristle tufts. Furthermore, each of the bristle tufts may include a plurality of bristles 719.

The bristle 719 is merely depicted in grayscale to indicate that the oral care feature of the bristle 719 is an additive 770 that triggers a trigeminal response during use of the bristle 719 to clean a user's oral surfaces. Although depicted as grayscale, this can be particles or the like as discussed above with regard to the bristle 619. It is desirable to be able to inform a consumer that the oral care implement 700 comprises the bristles 719 with the oral care feature of the additive 770 that triggers a trigeminal response so that the consumer can readily perceive that the oral care implement 700 will provide the aforementioned benefits. This unique oral care feature of the bristles 719 is not readily apparent to a typical consumer simply by viewing the bristles 719. Therefore, the oral care implement 700 is designed with a conspicuous structural feature, described below, that may inform the user of the oral care feature of the bristles 719.

Specifically, in this embodiment the core component 730 of the oral care implement 700 comprises a structural feature that is a symbolic element 765 communicative of the trigeminal response of the bristle 719. In the exemplified embodiment the symbolic element 765 is a three-dimensional representation of a snowflake to indicate that the additive 770 of the bristle 719 triggers a cooling sensation during use. Alternatively, the symbolic element 765 may be a three-dimensional representation of a fire to be communicative of a heating sensation if the additive 770 of the bristle 719 triggers such a heating sensation. Thus, in this embodiment a consumer can be made aware of the trigeminal response of the additive 770 of the bristle 719 simply by viewing the symbolic element 765 of the core component 730. In the exemplified embodiment the symbolic element 765 is formed as a part of and integrally with the core component 730. This can be achieved via injection molding or otherwise. However, the symbolic element 765 may be a separate element from the core component 730 in other embodiments and it may be maintained separate from the core component 730 or coupled thereto using techniques known in the art (i.e., welding, adhesives, fastener elements, etc.) if so desired.

Although in the exemplified embodiment the symbolic element 765 of the core component 730 is a three-dimensional structure, in other embodiments the symbolic element 765 may be an embossing or a debossing formed into the core component 730. Thus, the symbolic element 765 may be a representation that is formed as a recess in a specific shape (i.e., a snowflake as in the exemplary embodiment) rather than as a three-dimensional structure.

Figure 11:
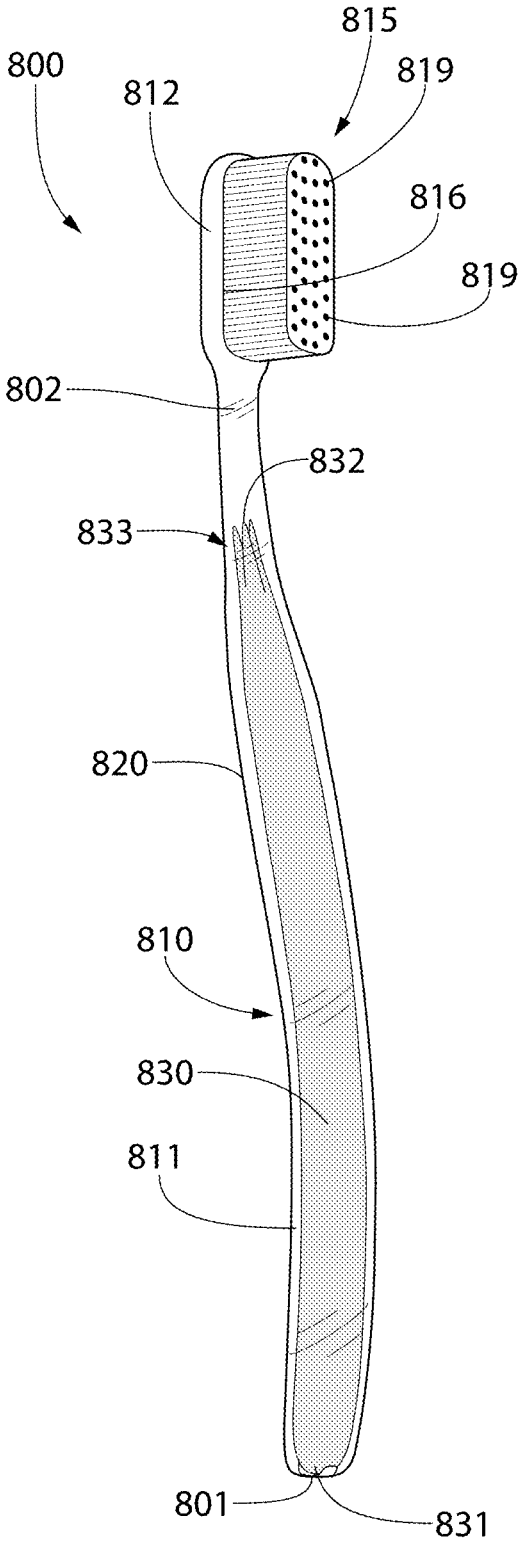
FIG. 11 is a front perspective view of an oral care implement in accordance with an eighth embodiment of the present invention.
Figure 11A:
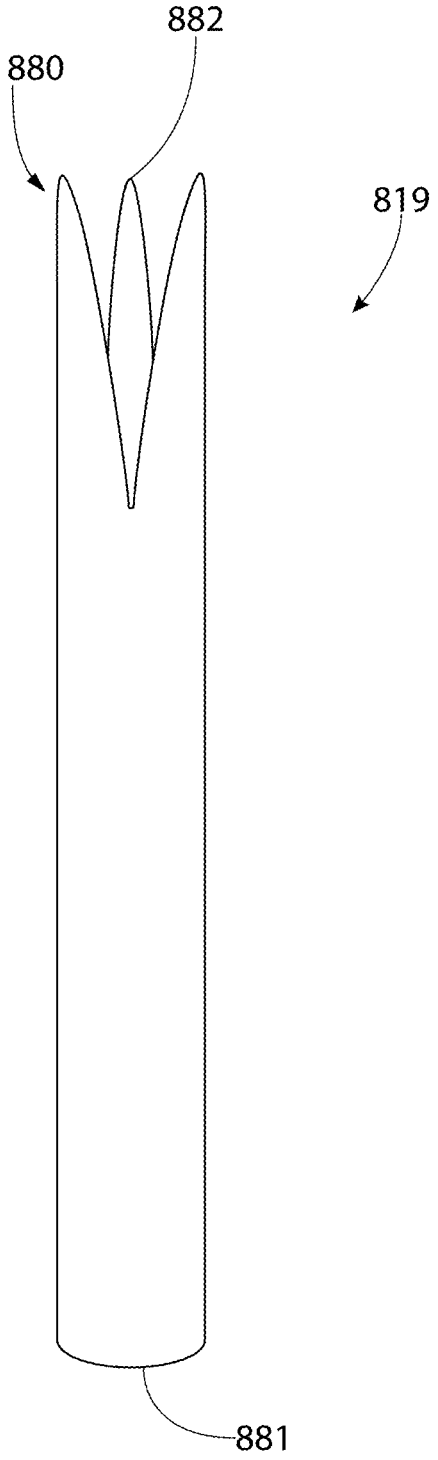
FIG. 11A is a schematic illustration of a bristle on the oral care implement of FIG. 11.

Referring to FIGS. 11 and 11A concurrently, one exemplary embodiment of an oral care implement 800 will be described. The oral care implement 800 is similar to the oral care implement 100 except for the differences described herein below. The features of the oral care implement 800 that are described above with regard to the oral care implement 100 will not be repeated herein in the interest of brevity, it being understood that the description above with regard to the oral care implement 100 applies. Furthermore, features of the oral care implement 800 will be similarly numbered as similar features on the oral care implement 100 except that the 800-series of numbers will be used. For features of the oral care implement 800 that are numbered but not described, it should be understood that the description of the similar feature in the oral care implement 100 applies.

The oral care implement 800 comprises a body 810 having a handle portion 811 and a head portion 812. The body 810 comprises a sheath component 820 and a core component 830 that are similar in structure to the sheath and core components 120, 130 of the oral care implement 100 described above except for the differences described below. A plurality of tooth cleaning element 815 extends from a front surface 816 of the head portion 812. As described above with regard to the oral care implement 100, the plurality of bristles 815 may include at least one, or a plurality of bristle tufts. Furthermore, each of the bristle tufts may include a plurality of bristles 819.

Referring to FIG. 11A, the bristle 819 comprises an oral care feature in the form of a multi-tip end 880 of the bristle 819. Thus, the bristle 819 extends from a proximal end 881 that is embedded within the head 812 of the oral care implement 800 to a distal end 882 that is the free end used to contact a user's teeth and gums during oral cleaning. As the bristle 819 extends towards the distal end 882, the bristle 819 splits into multiple tips to form the multi-tip end 880 of the bristle 819. In the exemplified embodiment the bristle 819 has a tri-tip end. However, the invention is not to be so limited and the bristle may be a dual-tip end, or the bristle may split into any number of tips greater than three tips if so desired. The multi-tip end 880 provides an oral care benefit of having more bristle surfaces contacting a user's teeth and gums from a single bristle. Furthermore, splitting the end of the bristle 819 into multiple tips results in the tips being thinner so that they may more readily extend into the very small spaces between adjacent teeth and between the teeth and gums during toothbrushing.

As with the oral care features discussed above, a user will not be able to readily perceive that the bristle 819 has the multi-tip end 880 by viewing the bristle 819 because it is on a very small scale. Therefore, in order to communicate to a consumer that at least one of the bristles 819 oral care implement 800 includes the oral care feature of the multi-tip end 800, the core component 830 comprises a conspicuous structural feature that is indicative or communicative or representative of the multi-tip end 880 oral care feature of the bristle 819. In that regard, the core component 830 extends from a proximal end 831 adjacent a proximal end 801 of the handle portion 811 of the body 810 to a distal end 832 adjacent a distal end 802 of the handle portion 811 of the body 810. The structural feature of the core component 830 is a multi-tip end portion 833. Specifically, the core component 830 splits into multiple tips at the distal end 832 of the core component 830 in a similar manner to the split of the bristle 819 forming the multi-tip end 880 of the bristle 819. The multi-tip end 833 of the core component 830 may be configured to correspond to the multi-tip end 880 of the bristle 819 such that the number of tips at the multi-tip end 833 of the core component 830 is the same as the number of tips at the multi-tip end 880 of the bristle 819.

Thus, in accordance with this embodiment, a consumer viewing the oral care implement 800 will readily see that the core component 830 has the structural feature of the multi-tip end 833. This will non-verbally communicate to the consumer that at least one of the bristles 819 on the oral care implement 800 comprises the oral care feature of the multi-tip end 880 and the benefits achieved thereby.

Figure 12:
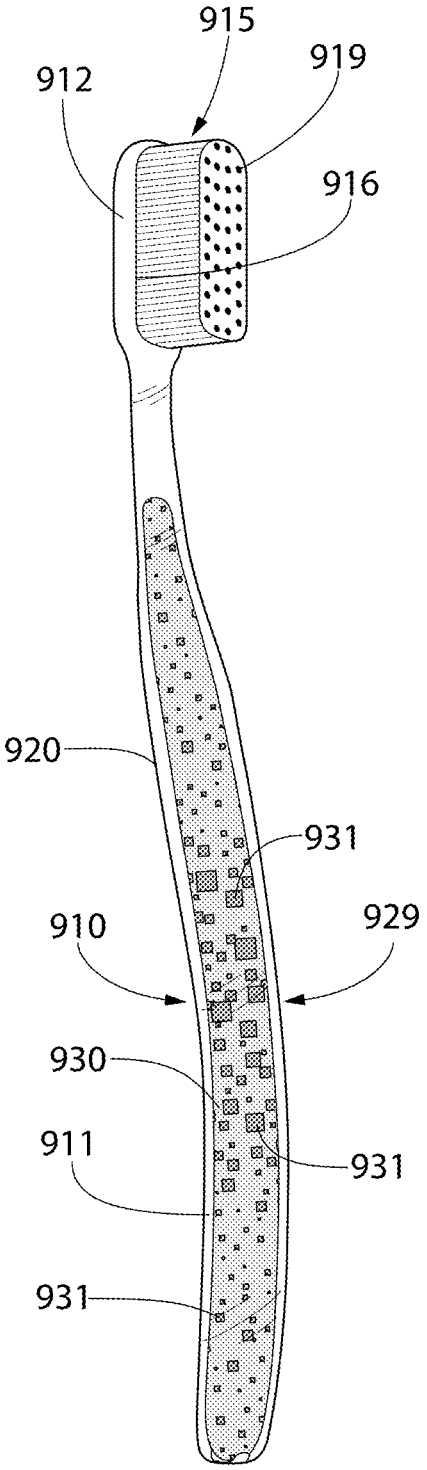
FIG. 12 is a front perspective view of an oral care implement in accordance with a ninth embodiment of the present invention.

Referring to FIG. 12, an oral care implement 900 is illustrated. The oral care implement 900 comprises a body 910 having a handle portion 911 and a head portion 912. The body 910 comprises a sheath component 920 and a core component 930 that are similar in structure to the sheath and core components 120, 130 of the oral care implement 100 described above except for the differences described below. A plurality of tooth cleaning element 915 extends from a front surface 916 of the head portion 912. As described above with regard to the oral care implement 100, the plurality of bristles 915 may include at least one, or a plurality of bristle tufts. Furthermore, each of the bristle tufts may include a plurality of bristles 919.

In this embodiment, the core component 930 comprises a plurality of particulates 931 therein similar to that which was disclosed above with reference to FIG. 9. However, the difference between this embodiment and the oral care implement 600 of FIG. 9 is that a portion 929 of the sheath component 920 is configured to magnify the visible appearance of the structural feature (i.e., the particulates) from outside of the body 910. Thus, the portion 929 of the sheath component 920 is formed from a material that magnifies objects when a person looks through the portion 929 of the sheath component 920. The material may be glass, plastic, or any other material now known or later discovered to be capable of creating the magnifying effect when a person views an object through the material. In certain embodiments the entirety of the sheath component 920 may be formed from the material that magnifies objects when a person looks through the sheath component 920. Thus, the sheath component 920 will make the structural feature of the core component 930, which in the exemplified embodiment are the particulates 931, even more pronounced and visible to a consumer because the structural feature of the core component 930 will be viewable through the portion 929 of the sheath component 929.

Although the magnification is described and illustrated herein with regard to an embodiment where the structural feature of the core component 930 is the particulates 931, the invention is not to be so limited in all embodiments. The sheath component 930 may include a magnified portion 929 in any of the embodiments described herein above. Thus, the magnified portion 929 of the sheath component 930 may be included in any of the other embodiments described herein to magnify any of the following structural features: the multi-tip end 833 of the core component 830 of the oral care implement 800 of FIG. 11; the symbolic element 765 of the oral care implement 800 of FIG. 10; the uneven core outer surface topography 538 of the core component 530 of FIG. 8; the intertwined core strand components 434, 435 of the core component 430 of FIG. 7; and the tapered end portion 233 of the core component 230 of the oral care implement 200 of FIG. 5; or any other structural feature used in accordance with the disclosure set forth herein.

Several exemplary embodiments of the present invention have been described herein with reference to the drawings. However, it should be appreciated that the description and accompanying drawings are merely exemplary and are not intended to be all inclusive or limiting. Thus, the core components may have structural features that are different than those disclosed herein to correspond to an oral care feature of a bristle that is different than those described herein. The idea is simply that the core component has a structural feature that corresponds to an oral care feature of the bristle(s). Stated another way, the core component has a structural feature that is representative of or indicative of the oral care feature of the bristle(s). In certain embodiments (including all of the embodiments exemplified herein) the structural feature of the core component may be free of alpha-numeric characters.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a body comprising a handle portion and a head portion;

at least one bristle mounted to and extending from the head portion, the at least one bristle having an oral care feature;

the body comprising a core component and a sheath component surrounding the core component;

the core component comprising a structural feature that corresponds to the oral care feature and that is visible through the sheath component;

wherein the oral care feature is a tapered bristle tip portion and the structural feature is a tapered end portion; or wherein the oral care feature is intertwined bristle strand components and the structural feature is intertwined core strand components; and wherein the sheath component is configured to magnify a visible appearance of the structural feature from outside of the body.

2. The oral care implement according to claim 1 wherein the intertwined bristle strand components comprise a first bristle strand component that is a first color and a second bristle strand component that is a second color, the first color being different than the first color; and wherein the intertwined core strand components comprise a first core strand component that is the first color and a second core strand component that is the second color.

3. The oral care implement according to claim 1 wherein the handle portion comprises the core component and the sheath component.

4. The oral care implement according to claim 1 wherein the sheath component envelops the core component.

5. The oral care implement according to claim 1 wherein the structural feature is free of alpha-numeric characters.

6. The oral care implement according to claim 1 wherein the sheath component is formed of a transparent material.

7. An oral care implement comprising:

a body comprising a handle portion and a head portion;

at least one bristle mounted to and extending from the head portion, the at least one bristle having an oral care feature;

the body comprising a core component and a sheath component surrounding the core component;

the core component comprising a structural feature that corresponds to the oral care feature and that is visible through the sheath component;

wherein the oral care feature is an additive and the structural feature is particulates dispersed in a carrier material of the core component; and wherein the sheath component is configured to magnify a visible appearance of the structural feature from outside of the body.

8. The oral care implement according to claim 7 wherein the particulates of the structural feature and the additive of the oral care feature are the same color.

9. The oral care implement according to claim 7 wherein the particulates of the structural feature have a color that is indicative of a trigeminal response triggered by the additive of the oral care feature.

10. The oral care implement according to claim 7 wherein the additive of the oral care feature is dispersed in the at least one bristle in particulate form.

11. The oral care implement according to claim 7 wherein the additive of the oral care feature is within the at least one bristle.

12. The oral care implement according to claim 7 wherein the core component is entirely encapsulated by the sheath component.

* * * * *